US005615431A

United States Patent [19]

Vassilli

[11] Patent Number: 5,615,431

[45] Date of Patent: Apr. 1, 1997

[54] BED FRAMEWORK WHICH IS ADJUSTABLE IN ELEVATION

[75] Inventor: Berto Vassilli, Saonara, Italy

[73] Assignee: Givas Habitat s.r.l., Saonara, Italy

[21] Appl. No.: 565,174

[22] Filed: Nov. 30, 1995

[30] Foreign Application Priority Data

Apr. 6, 1995 [IT] Italy ..... PD95A0069

[51] Int. Cl.[6] ..... A61G 7/005

[52] U.S. Cl. ..... 5/610; 5/611

[58] Field of Search ..... 5/610, 611, 609, 5/108, 613

[56] References Cited

U.S. PATENT DOCUMENTS 4,345,344 8/1982 Gadoury et al. ..... 5/610

4,697,802 10/1987 Brendl et al. ..... 5/610

4,841,585 6/1989 Masuzawa ..... 5/610

*Primary Examiner*—Alexander Grosz

*Attorney, Agent, or Firm*—Joseph W. Molasky & Associates

[57] ABSTRACT

A bed framework comprising a base frame provided with casters and a supporting frame provided with at least one subframe movable and/or swingable with respect to said supporting frame. The two frames are connected to each other through at least two pairs of rods with associated arcuate guides secured to said base frame for allowing a change of the elevation and inclination of said supporting frame in respect of said base frame.

One end of each rods is pivotally connected to said supporting frame and the other end is provided with pins engaging guide slots in said arcuate guides whereby said supporting frame is vertically raised or lowered when said pins are moved along the guide slots of the associated arcuate guide.

10 Claims, 5 Drawing Sheets

BED FRAMEWORK WHICH IS ADJUSTABLE IN ELEVATION

BACKGROUND OF THE INVENTION

The present invention relates to a bed framework of the type comprising a base frame provided with casters and a supporting frame on which the mattress rests, which is adjustable in elevation, i.e. allows a change of the elevation and of the inclination of said supporting frame in respect of the base frame.

In beds for bedridden patients and/or medical treatments of several kinds it is often requested to adjust the elevation or height of the bed, as well as its tilt or inclination.

The raising means or devices employed to this aim can be of various kind. There are known hydraulic piston devices, mechanical, lead screw, crossed rods, trolley-like devices, and so on. In the different applications one takes into account the practicality and reliability of the manouvres to be carried out for raising or lowering the bed supporting frame. All other conditions being the same, the construction simplicity and the low cost of the raising apparatus are decisive factors in the choice, which in turn leads to an overall cost reduction.

The known arrangements of bed framework are not satisfactory in that either they are rather expensive, or have a complicated construcion or are difficult to be manouvred.

It is therefore an object of the present invention to realize a new and improved bed framework that is quite effective and extremely simple, so as to achieve the advantages of the known apparatuses and at the same time allowing for a cost reduction.

SUMMARY OF THE INVENTION

The invention consists in a bed framework comprising a base frame provided with casters and a supporting frame provided with at least one subframe movable and/or swingable with respect to said supporting frame, said two frames being connected to each other through means allowing a change of the elevation and inclination of said supporting frame in respect of said base frame, said means comprising at least two pairs of rods with associated arcuate guides, wherein said arcuate guides are secured to said base frame and one end of each rods is pivotally connected to said supporting frame and the other end is provided with pins engaging guide slots in said arcuate guides whereby said supporting frame is vertically raised or lowered when said pins are moved along the guide slots of the associated arcuate guide.

In accordance with the invention, the raising of the bed frame is accomplished through pairs of rods and arcuate guides only.

When the rod ends provided with guide pins are moved along a curved guide, the ends of the rod that are connected to the upper frame are moved along a path that can be rectilinear or straight.

By securing the arcuate guide to the base frame and by connecting one end of the rod to the frame the elevation of which is to be adjusted, the motion of the supporting frame with respect to the base frame (both raising and lowering) is achieved by moving the lower ends of the rods of a certain desired amount along the arcuate guides to which they are coupled, thanks to guide pins provided thereon.

The frame capable to be adjusted in elevation can be either the bed main frame or it can be a frame acting as a supporting frame for an additional fixture comprising subframes that are movable and/or swingable.

BRIEF DESCRIPTION OF THE DRAWINGS

A preferred but non-limiting embodiment of the invention will now be disclosed with reference to the attached drawings in which.

DETAILED DESCRIPTION OF THE PREFERRED EMBODIMENT

Figure 1:
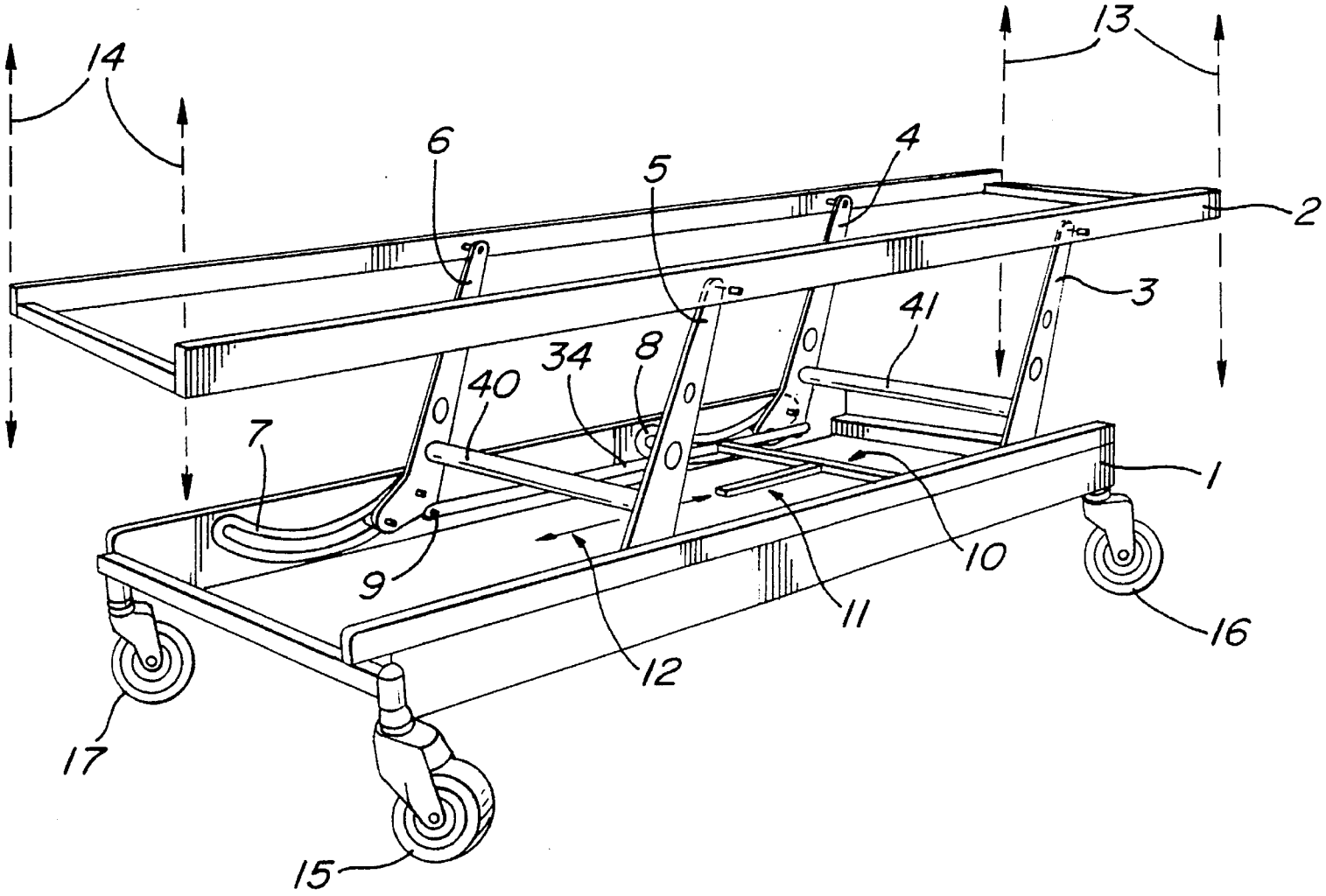
FIG. 1 is a schematical assonometric view of a bed framework of the present invention.
Figure 2:
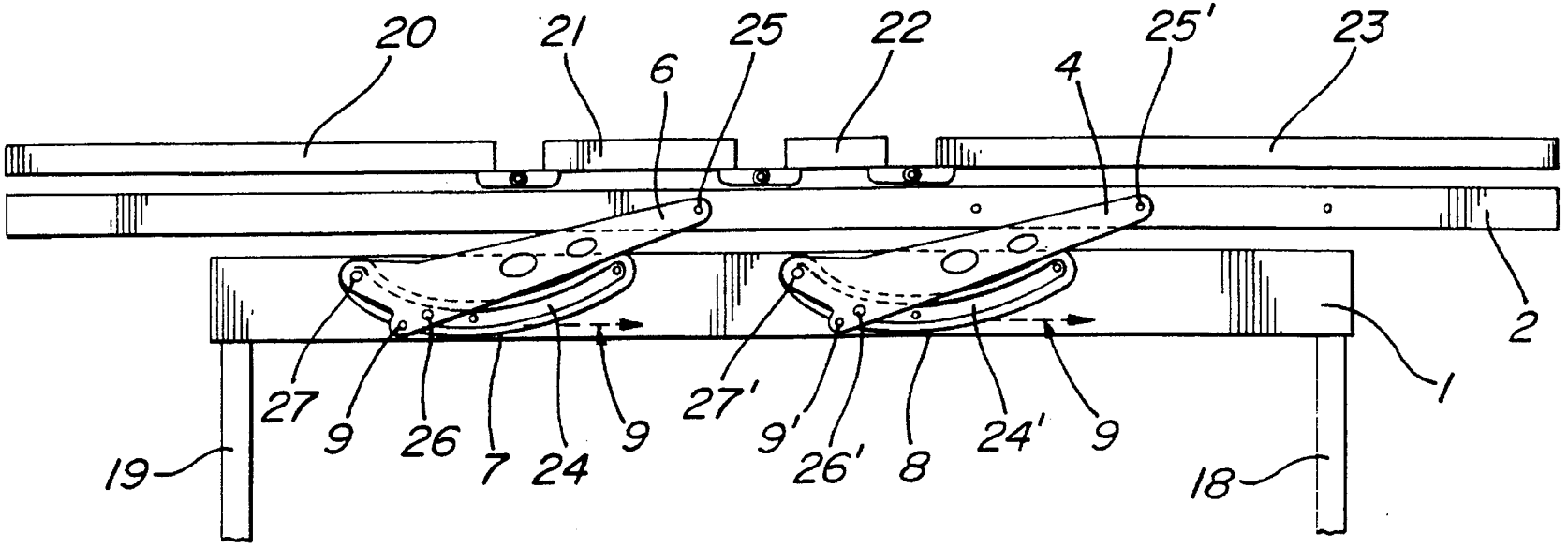
FIG. 2 schematically shows a side view of the bed framework in a lowered or retracted position.
Figure 3:
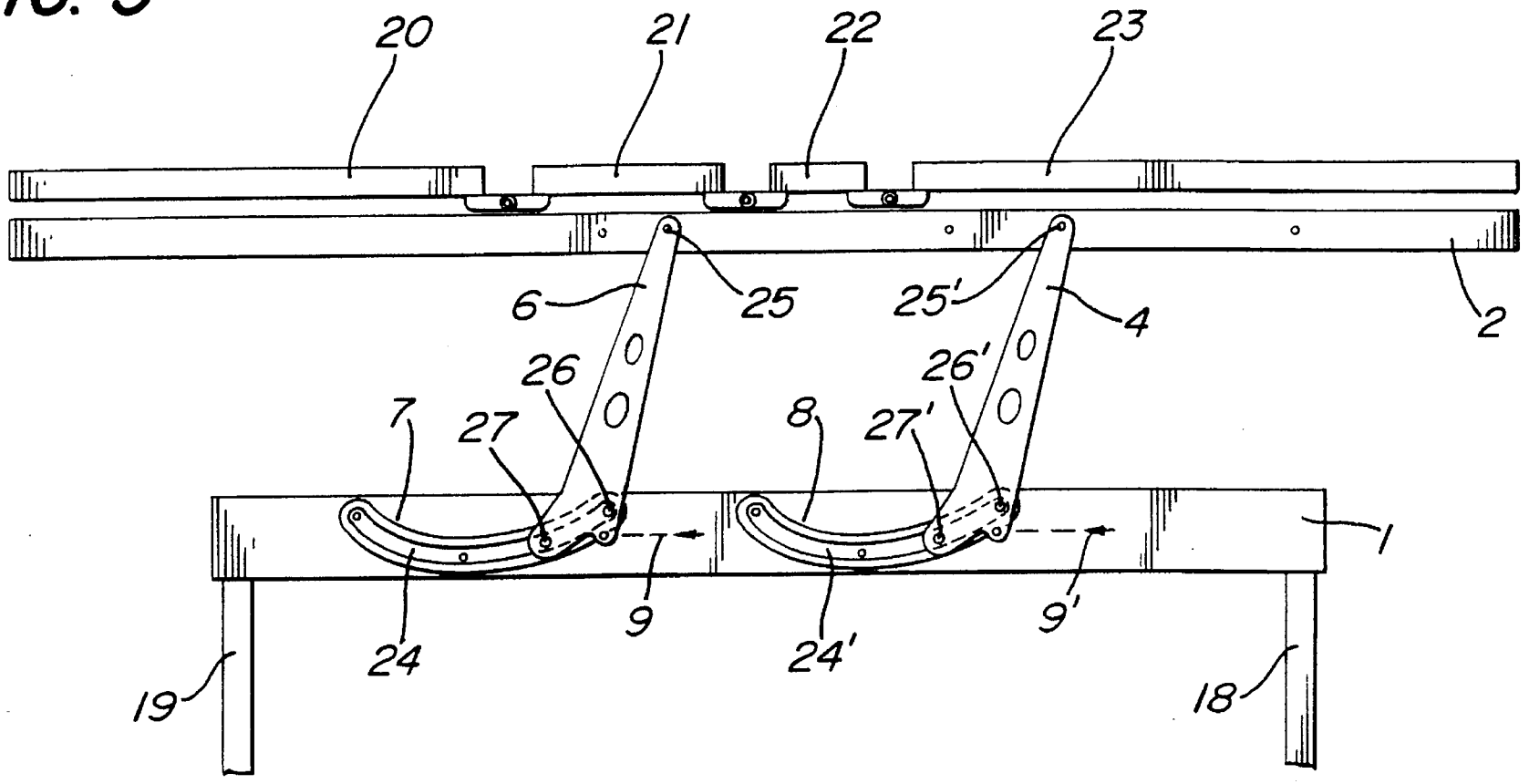
FIG. 3 schematically shows a side view of the bed framework in a raised or extended position.
Figure 4:
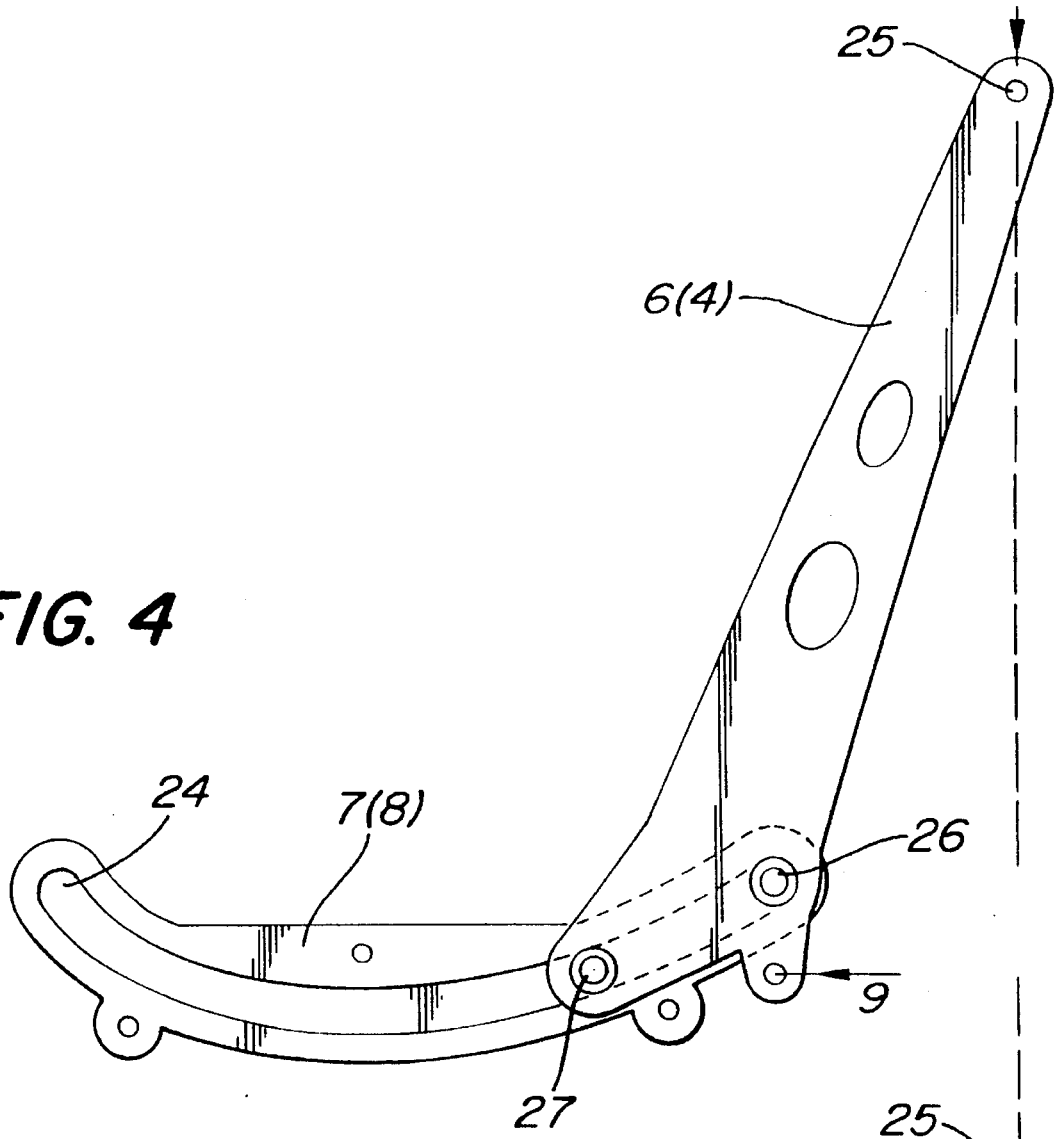
FIG. 4 illustrates the coupling between a guide 7 and a rod 6 in a raised position.
Figure 5:
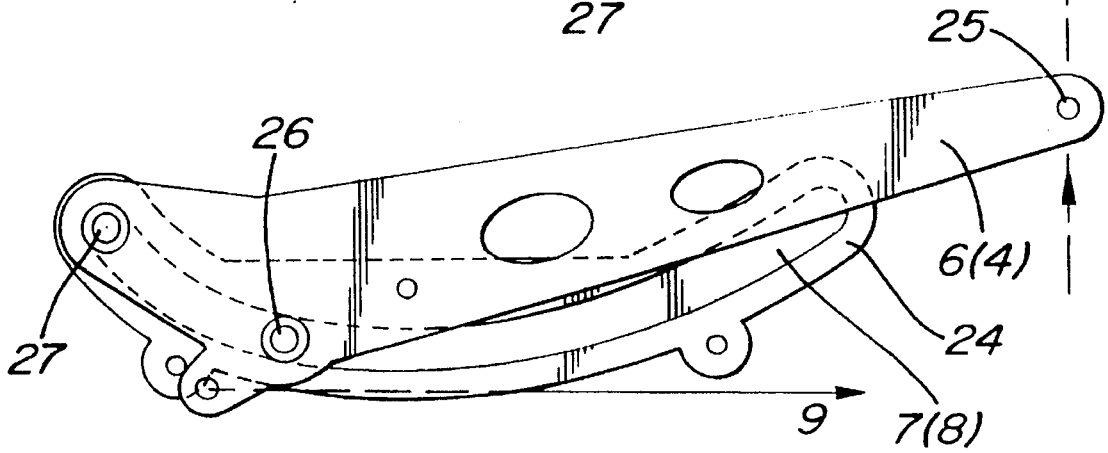
FIG. 5 illustrates the coupling between a guide 7 and a rod 6 in a lowered position.
Figure 6:
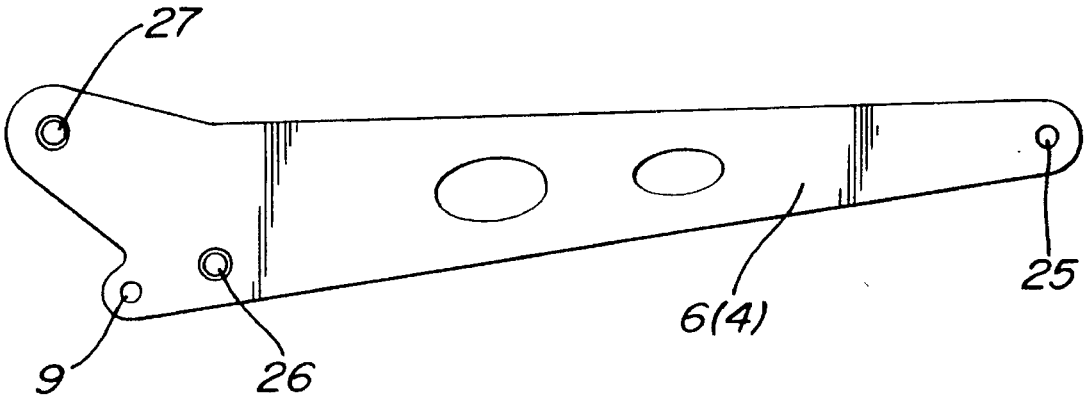
FIG. 6 illustrates the construction of a connecting rod.

With reference to the Figures, and particularly to FIG. 1, a bed framework according to the invention comprises a base frame or lower frame 1 provided with casters 15, 16, 17 and connected to a supporting frame or upper frame 2 that can be adjusted in elevation and inclined with respect to the base frame. As better shown in FIGS. 2 and 3, the upper frame 2 is preferably provided with subframes 20, 21, 22 and 23 mounted on the upper frame 2 and movable and/or swingable with respect to this latter.

The frames 1 and 2 are connected to each other by means of two pairs of rods 3, 4 and 5, 6 and two pairs of associated arcuate guides, only those shown at 7 and 8 and located on one side being shown in FIG. 1. More particalarly, as better shown in FIGS. 2 and 3, the upper end 25 of each of the rods 5 and 6 of a pair of rods is pivotally connected to a longitudinal rail of the supporting frame 2, while each of the other (lower) ends is provided with two projecting pins.26 and 27 engaging an arcuate groove or slot 24 of a respective arcuate guide 7 which is secured to a longitudinal rail of the base frame 1. A similar arrangement is provided for the rods 3 and 4, one end (25') of which is pivoted to the supporting frame 2 while the other end is provided with two projecting pins 26' and 27' engaging a groove or slot 24' of arcuate guide 8.

As shown in FIG. 1, the two rods 5, 6 are connected together by a transverse bar 40 and the two rods 3, 4 are connected by a transverse bar 41. Moreover the rods 6 and 4 are connected together by a longitudinal bar 34 the ends of which are pivotally fastened to projecting pins or projections 9 and 9' of the rods 6 and 4, respectively. A similar connecting bar (not shown in FIG. 1) is provided for joining together rods 3 and 5 and a cross bar 10 connects together the connecting bars 34, thus forming an H-shaped frame through which the rod ends carrying the guide pins 26, 27 and 26', 27' can be moved together within the grooves of the arcuate guides.

Moreover a longitudinal stem 11 is fixed at the center of cross bar 10. Reference 12 indicates the direction along which a force is applied to cross bar 10, while references 13 and 14 indicate the paths along which the displacements of the upper frame 2 occur, and such paths can be rectilinear or straight paths.

Figure 7:
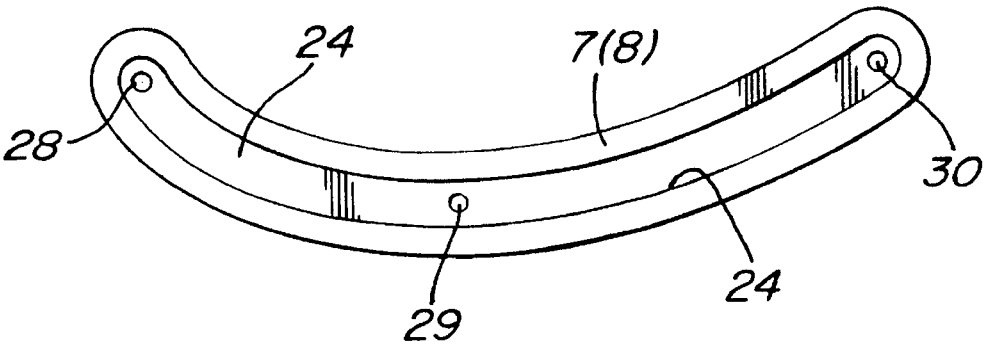
FIG. 7 shows a construction of an arcuate guide.
Figure 8:
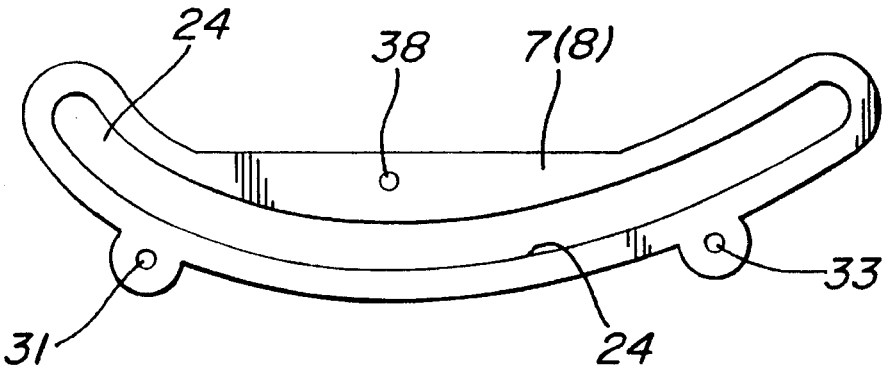
FIG. 8 shows another construction of an arcuate guide provided with fastening lugs.

As better shown in FIG. 7 and 8, the arcuate guides 7 and 8 are formed as plates extending for a circumferential arc and being provided with an arcuate groove 24 or 24' within which the guide pins 26 27 and 26', 27' are movable In the embodiment shown in FIG. 7, holes 28, 29 and 30 are formed in the groove 29 for securing the guide to the lower frame 2, while in the embodiment of FIG. 8, holes 31, 33 and 38 are drilled respectively in two lugs and a central web formed in the plate.

The upper frame 2 can be displaced with respect to frame 1 by applying a force either to the pair of rods located near the foot of the bed (e.g. 5 and 6), or to the pair of rods located near the head of the bed (e.g. 3 and 4), or to all the four rods at the same time. In the first two cases the bed supporting frame is positively or negatively inclined, respectively, whereas in the third case the displacement of the bed supporting frame is substantially vertical.

More precisely, the simultaneous movement of the four rods 3, 4, 5, 6 is obtained by applying a force along the longitudinal direction 12 and acting on the longitudinal stem 11 through means (not illustrated in the drawings) that moves forwards or rearwards the H-shaped frame (formed by the cross bar 10 and the two longitudinal bars 34) connecting the four projections 9 and 9' for the attachement of the rods 6 and 4.

The extension of the arcuate guides and the length of the rods are such as to allow a person to easily climb over the bed and seat onto it when the upper frame is in the lowered position, while rendering easy the care and the assistance to a person laying on the bed, when the bed is in the raised position.

From the above description it is evident that the bed framework of the invention has a simple and inexpensive construction while being at the same time quite reliable and easy to be handled.

I claim:

1. A bed framework comprising a base frame provided with casters and a supporting frame provided with at least one subframe movable and/or swingable with respect to said supporting frame, said two frames being connected to each other through means allowing a change of the elevation and inclination of said supporting frame with respect of said base frame, said means comprising at least two pairs of rods with associated arcuate guides, wherein said arcuate guides are secured to said base frame and one end of each rods is pivotally connected to said supporting frame and the other end is provided with pins engaging guide slots in said arcuate guides whereby said supporting frame is vertically raised or lowered when said pins are moved along the guide slots of the associated arcuate guide.

2. A bed framework as claimed in claim 1, wherein said one end of each rods is moved along a rectilinear path when said pins move along said arcuate guides.

3. A bed framework as claimed in claim 1, wherein said arcuate guides are formed as plates extending for a circumferential arc and being provided with arcuate grooves.

4. A bed framework as claimed in claim 3, wherein said arcuate guides are provided with holes formed in the groove for securing the guides to said supporting frame.

5. A bed framework as claimed in claim 3, wherein said arcuate guides are provided with two lugs and a central web in which holes are formed for securing the guides to said supporting frame.

6. A bed framework as claimed in claim 3, wherein each said other end of each rods is provided with two projecting pins for engaging said groove of the arcuate guides.

7. A bed framework as claimed in claim 1, wherein a force for raising or lowering the upper frame is applied at a projection located near said rod pins.

8. A bed framework as claimed in claim 7, wherein by applying a force either to the pair of rods located near the foot of the bed or to the pair of rods located near the head of the bed, said bed supporting frame is positively or negatively inclined, respectively.

9. A bed framework as claimed in claim 8, wherein the simultaneous movement of the four rods is obtained by applying force to an H-shaped frame comprised of two longitudinally disposed bars pivotally fastened to said rods and connected to one another by a cross bar.

10. A bed framework as claimed in claim 7, wherein by applying a force to all the four rods at the same time said bed supporting frame is vertically moved.

* * * * *